US010879614B2

(12) United States Patent
Ghezzo et al.

(10) Patent No.: US 10,879,614 B2
(45) Date of Patent: Dec. 29, 2020

(54) HELICOIDAL, MIXED POLARIZATION MONO-CONICAL ANTENNA

(71) Applicant: HI-TE S.R.L., Goro (IT)

(72) Inventors: Enrico Ghezzo, Gora (IT); Antonello Giovannelli, Gora (IT)

(73) Assignee: HI-TE S.R.L.

( * ) Notice: Subject to any disclaimer, the term of this patent is extended or adjusted under 35 U.S.C. 154(b) by 0 days.

(21) Appl. No.: 16/479,981

(22) PCT Filed: Jan. 13, 2018

(86) PCT No.: PCT/IB2018/050224
§ 371 (c)(1),
(2) Date: Jul. 23, 2019

(87) PCT Pub. No.: WO2018/134715
PCT Pub. Date: Jul. 26, 2018

(65) Prior Publication Data

US 2019/0372231 A1 Dec. 5, 2019

(30) Foreign Application Priority Data

Jan. 23, 2017 (IT) ..... 102017000006949

(51) Int. Cl.
*H01Q 11/08* (2006.01)
*H01Q 1/36* (2006.01)
*H01Q 9/38* (2006.01)

(52) U.S. Cl.
CPC ..... *H01Q 11/083* (2013.01); *H01Q 1/362* (2013.01); *H01Q 9/38* (2013.01)

(58) Field of Classification Search
CPC ..... H01Q 11/08; H01Q 11/083; H01Q 1/36; H01Q 1/362; H01Q 9/36; H01Q 9/38;
(Continued)

(56) References Cited

U.S. PATENT DOCUMENTS 5,132,696 A * 7/1992 Cobb ..... H01Q 1/081 343/709
5,835,067 A 11/1998 Goodman
(Continued)

FOREIGN PATENT DOCUMENTS

WO 97/01196 A1 1/1997

OTHER PUBLICATIONS

International Search Report, PCT/IB2018/050224, dated May 9, 2018, 3 pages.

*Primary Examiner* — Haissa Philogene
(74) *Attorney, Agent, or Firm* — Ware, Fressola, Maguire & Barber LLP

(57) ABSTRACT

A helicoidal, mixed polarization mono-conical antenna has: a supporting structure (2) with a longitudinal axis (2*a*); ground conductors (3) connected to an area around a first portion (4) of the supporting structure (2) defining a ground plane (21) of the antenna (1) orthogonal to the axis (2*a*); at least three signal conductors (7), which have respective first ends (8) that are connected to a second portion (5) of the supporting structure (2) and respective second ends (10) that are connected to a third portion (6) of the supporting structure (2) located between the first portion (4) and the second portion (5) along the axis (2*a*), the conductors wound in a helicoidal manner relative to the axis (2*a*) and shaped so as to define a substantially frusto-conical volume (12) which is coaxial to the axis (2*a*) and is oriented with a smaller base towards the first portion (4).

14 Claims, 2 Drawing Sheets

(58) Field of Classification Search
CPC .. H01Q 5/40; H01Q 5/42; H01Q 5/48; H01Q 5/371
See application file for complete search history.

(56) References Cited

U.S. PATENT DOCUMENTS 6,172,655 B1 * 1/2001 Volman ..... H01Q 1/36 343/895
6,421,028 B1 * 7/2002 Ohgren ..... H01Q 11/08 343/850
9,923,266 B1 * 3/2018 Casperson ..... H01Q 21/061

* cited by examiner

HELICOIDAL, MIXED POLARIZATION MONO-CONICAL ANTENNA

TECHNICAL FIELD

The present invention relates to a helicoidal, mixed polarization mono-conical antenna.

In particular, the present invention finds advantageous, but not exclusive, application in mobile transceiver equipment for terrestrial, nautical and satellite radiocommunications, to which the following description will make explicit reference without any prejudice to generality.

BACKGROUND ART

Equipment for terrestrial and nautical radio communications includes antennas normally having a vertical polarization aimed at behaving in the same way as the stylus antennas of mobile transceiver equipment, which are mostly used by operators on a territory or at sea, and an omnidirectional radiation pattern in the horizontal plane to allow an easy connection between different operators regardless of their mutual position.

Satellite radiocommunication devices comprise antennas that usually have an omnidirectional radiation pattern in the horizontal plane and an analogous circular polarization, i.e. with the same rotation direction as that of the antenna on board the satellite.

TECHNICAL PROBLEM

Simple, known antennas fail to operate with a high and uniform efficiency both in a band of terrestrial or nautical radio communications frequencies between 200 and 500 MHz, and in a band of satellite radiocommunication frequencies between 240 and 320 MHz, or they are limited by having an exclusively vertical or exclusively circular polarization.

To operate in both the above mentioned frequency bands these radiocommunication mixed devices comprise complex antennas, which are obtained by mechanical joining different types of simple antennas, i.e. operating on different frequency bands and having different polarizations. The disadvantages of this solution include a certain mechanical fragility, a big spatial encumbrance and the need for a plurality of signal input connectors, each electrically connected to a respective antenna, and/or a signal channeling system allowing the use of the equipment simultaneously on all the frequency bands.

OBJECTS OF THE INVENTION

Object of the present invention is to provide an antenna for terrestrial, nautical and satellite radiocommunication, which is free from the drawbacks described above and, at the same time, is easy and cheap to produce.

SUMMARY OF THE INVENTION

In accordance with the present invention an helicoidal, mixed polarization mono-conical antenna is provided as defined in the appended claims, including: a supporting structure with a longitudinal axis; a plurality of ground conductors connected in a radial pattern to an area around a first portion of the supporting structure to define a ground plane of the antenna orthogonal to the axis; at least three signal conductors, which have respective first ends that are connected to a second portion of the supporting structure and respective second ends that are connected to a third portion of the supporting structure situated between the first portion and the second portion along the axis, are wound in a helicoidal manner relative to the axis and are shaped so as to define a substantially frusto-conical volume which is coaxial with the axis and is oriented with the smaller base towards the first portion; and a coaxial power supply connector having a hot pole electrically connected to said second ends.

BRIEF DESCRIPTION OF THE DRAWINGS

The present invention will now be described with reference to the accompanying drawings, which illustrate a non-limiting exemplary embodiment, in which.

DESCRIPTION OF EMBODIMENTS OF THE INVENTION

Figure 1:
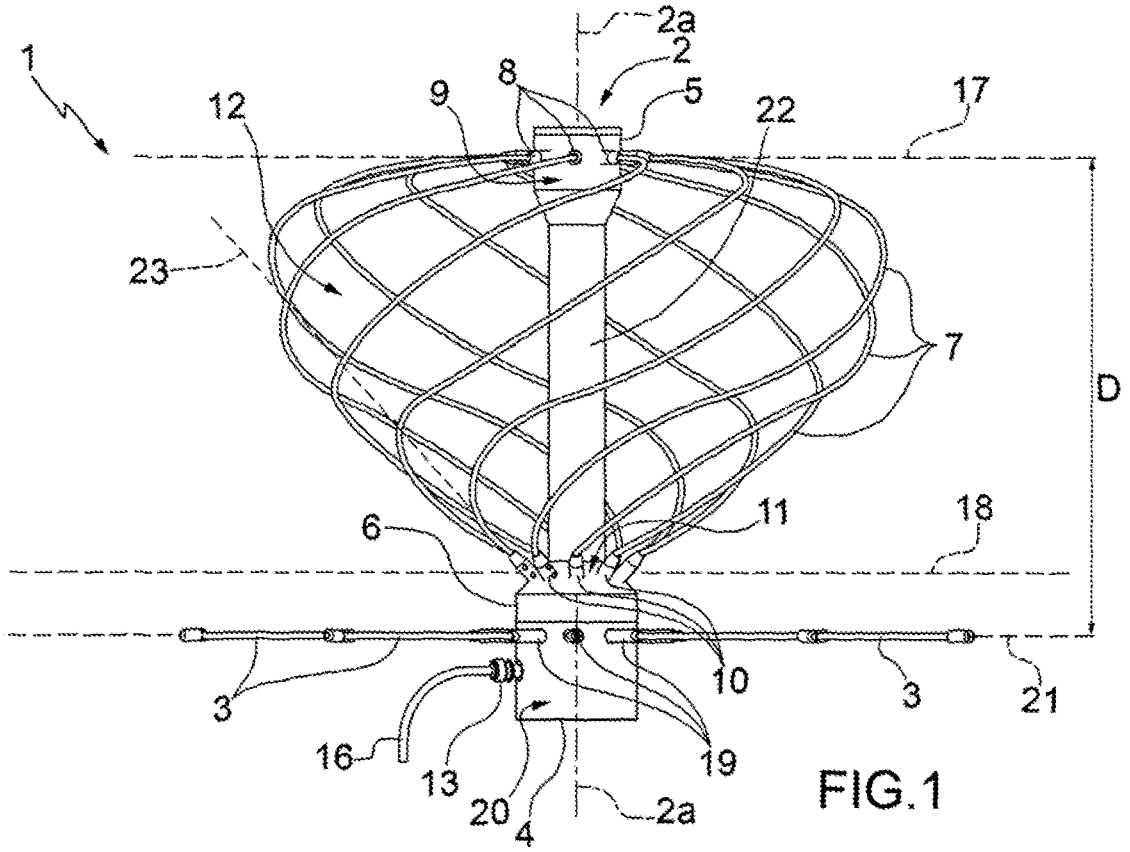
FIG. 1 shows a side view of the antenna made according to the teaching of the present invention.
Figure 2:
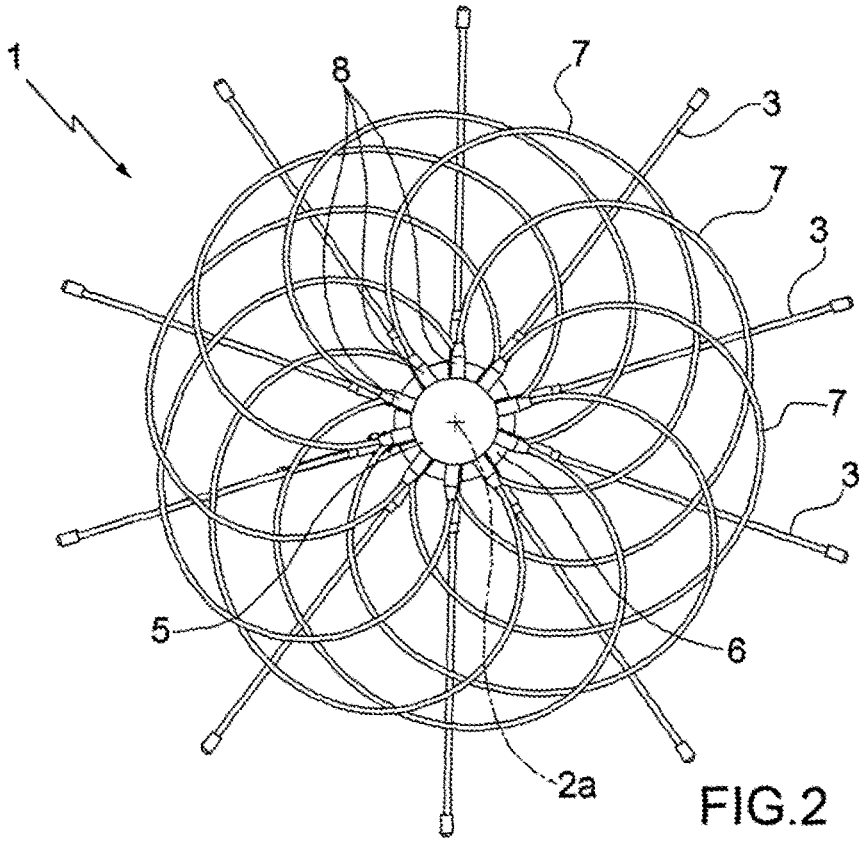
FIG. 2 shows a plan view of the antenna of FIG. 1.
Figure 3:
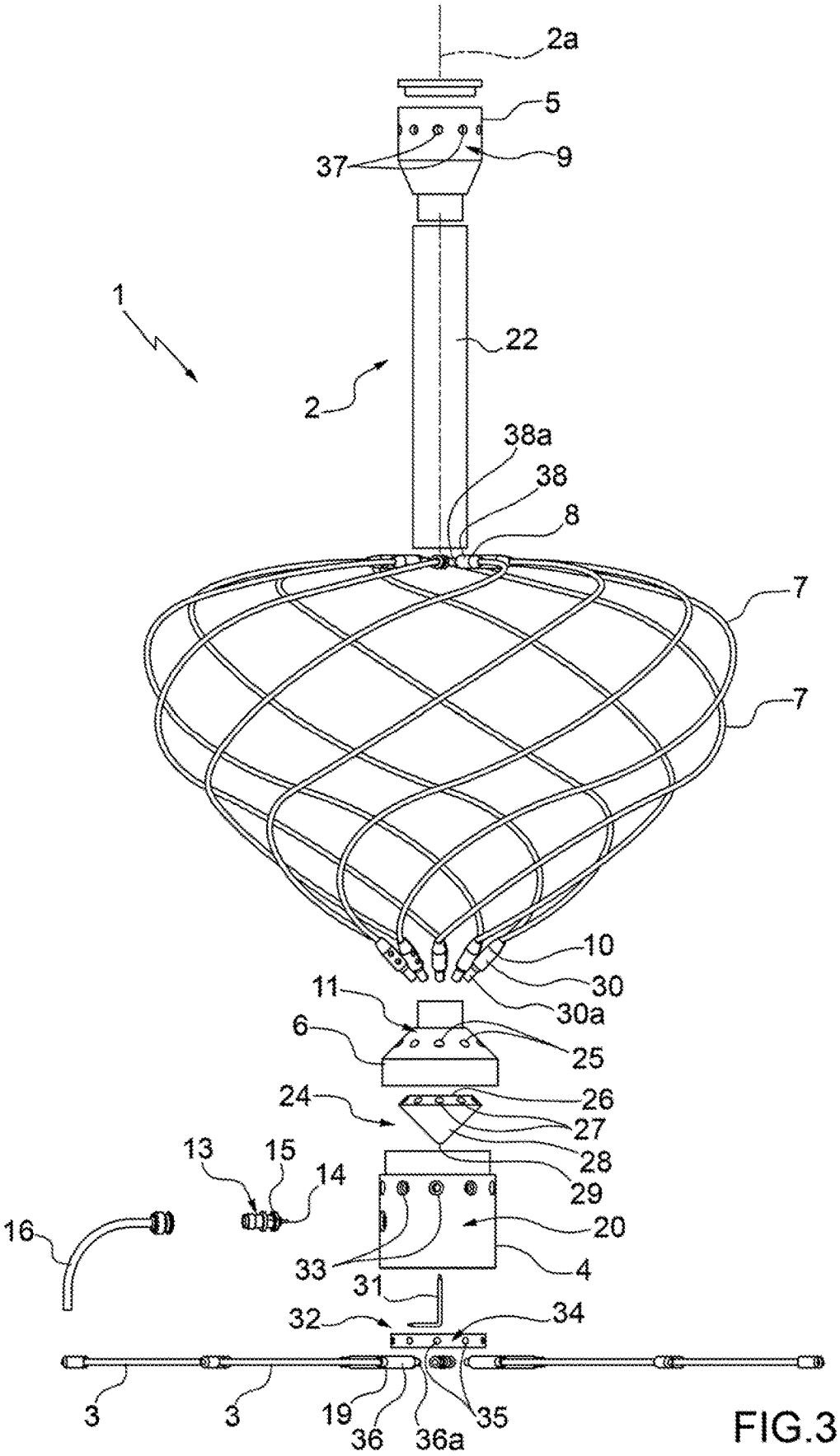
FIG. 3 shows an exploded side view of the antenna of FIG. 1.

In FIGS. 1-3, the antenna of the present invention is indicated as a whole with reference numeral 1. The antenna 1 comprises: a supporting structure 2 with a longitudinal axis 2*a*; a plurality of ground conductors 3 connected to an area around a base portion 4 of the supporting structure 2 so as to be arranged in a radial pattern with respect to the axis 2*a* to define a ground plane of antenna 1; at least three signal conductors 7, which have respective first ends 8 that are connected to a end portion 5 of the supporting structure 2 and respective second ends 10 connected to a further portion 6 of the supporting structure 2 situated between the portions 4 and 5 along the axis 2*a*, are wound in a helicoidal manner relative to the axis 2*a* and are shaped so as to define a substantially frusto-conical volume 12 which is coaxial to the axis 2*a* and is oriented with the smaller base towards the base portion 4; and a coaxial power supply connector 13 having the hot pole 14 (FIG. 3) electrically connected to the ends 10 of the signal conductors 7 and the ground 15 (FIG. 3) electrically connected to the ground conductors 3.

In particular, the first ends 8 of the signal conductors 7 are situated along a side surface 9 of the end portion 5, preferably having a cylindrical shape coaxial with the axis 2*a*, and the other ends 10 are situated along a side surface 11 of the further portion 6, preferably having a frusto-conical shape coaxial with the axis 2*a*.

FIGS. 1 and 3 also show a coaxial supply cable 16 that can be connected to the coaxial connector 13.

In the preferred embodiment illustrated by the figures, there are ten signal conductors 7: this number is the result of a compromise between mechanical complexity and performance of the antenna, in terms of efficiency constancy and input impedance matching, throughout the whole frequency band of use.

The antenna 1 is to be used preferably, but not necessarily, with the axis 2*a* in a vertical position with the base portion 4 at the bottom and the end portion 5 at the top. Each one of the signal conductors 7 consists of a respective metal strand, and in particular a steel cable, covered with an electrically insulating material. Therefore, the signal conductors 7 are made of a moldable but nonetheless flexible material.

Advantageously, each one of the ground conductors 3 also consists of a respective metal strand, and, in particular, a steel rope, covered with an electrically insulating material.

The ends 8 of the signal conductors 7 are connected to the end portion 5 so as to be angularly equispaced from one another with respect to the axis 2*a* and are intercepted by a first plane 17 orthogonal to the axis 2*a*. Similarly, the ends 10 of the signal conductors 7 are connected to the end portion 6 so as to be angularly equispaced from one another with respect to the axis 2*a* and are intercepted by a second plane 18 orthogonal to the axis 2*a*.

The ground conductors 3 comprise respective ends 19 arranged along a side surface 20 of the base portion 4 so as to be angularly equispaced from one another with respect to the axis 2*a*. The axes of the ground conductors 3 lie on a plane 21 orthogonal to the axis 2*a* which is in fact the aforementioned ground plane. Preferably, the side surface 20 has a cylindrical shape coaxial with the axis 2*a*.

The supporting structure 2 has an oblong portion 22 arranged between the portions 5 and 6 and having such a length that the value of the distance between the planes 17 and 21, indicated by Din FIG. 1, depends on a minimum operating frequency of the antenna 1, at which a determined efficiency of the antenna 1 is to be obtained.

In the embodiment shown in FIGS. 1-3, the coaxial connector 13 is positioned on the side surface 20 of the base portion 4. According to embodiments not shown of the invention, the coaxial connector 13 is positioned in the lower part of the base portion 4.

Each one of the signal conductors 7 is wound in a helicoidal manner over an angle θ having a value ranging from 80° to 190°. In the example shown in the figures, the angle θ is equal to 180°. Advantageously, the angle θ ranges between 100° and 120°. Preferably, the angle θ is 108° wide.

The angle θ determines the percentage of circular polarization with respect to the vertical polarization of the antenna, that is, the percentage of irradiated power with circular polarization with respect to the irradiated power with vertical polarization.

The preferred range of values of the angle θ gives the antenna 1 a substantial equivalence between circular and vertical polarization. Therefore, the antenna 1 is characterized by a mixed vertical and circular polarization. Furthermore, the preferred range of width of the angle θ produces a high antenna gain and at the same time acceptable ROS value and transverse encumbrance.

The helical winding direction of the signal conductors 7 defines the direction of the circular polarization. In the example shown in FIGS. 1-3, the signal conductors 7 are wound in such a way as to provide the antenna 1 with a right-handed polarization.

Preferably, but not necessarily, the ends 8 are connected substantially perpendicular to the side surface 9 of the portion 5, and the ends 10 are connected substantially perpendicular to the lateral side surface 11 of the further portion 6. The frusto-conical shape of the side surface 11 and the cylindrical shape of the side surface 9 facilitate maintenance of the shaping of the signal conductors 7, such as to define the frusto-conical volume 12.

In particular, the generatrix line 23 of the frusto-conical volume 12 forms, with the ground plane 21, an angle β that ranges between 35° and 55°. Advantageously, the angle β ranges between 40° and 50°. Preferably, the angle β is 45° wide.

With particular reference to FIG. 3, portions 4, 5, 6 and 22 of the supporting structure 2 are made of respective pieces mounted integrally to each other. The supporting structure 2 is made of an electrically insulating material. The portion 6 is internally hollow so as to house an electrical connection body 24 aimed at electrically connecting the signal conductors 7 to the hot pole 14 of the coaxial connector 13.

In more detail, the further portion 6 comprises a plurality of through holes 25, which are drilled along the side surface 11 in respective positions angularly equispaced from one another with respect to the axis 2*a*. The electrical connecting body 24 is preferably made of metal and comprises an upper portion 26 with frusto-conical shape, which is placed inside the further portion 6 beneath the lateral surface 11 and in coaxial relation with the axis 2*a* and has a plurality of holes 27 respectively coaxial with the holes 25, and a lower portion 28 having a substantially conical shape, which is coaxial with the portion 26 and at least partially arranged within the further portion 6, and has the vertex 29 facing the base portion 4 and electrically connecting the hot pole 14 of the power supply coaxial connector 13. The end 10 of each signal conductor 7 is provided with a respective connector 30, which passes through a respective hole 25 and is connected to a respective hole 27.

Preferably, each hole 27 is internally threaded and each connector 30 has a respective externally threaded end portion 30*a*, so as to be screwed in the respective hole 27.

The vertex 29 is electrically connected to the hot pole 14 by means of a connecting cable 31 with suitable shape and length, in order to allow input impedance matching of the antenna 1.

The conical shape of the lower portion 28 of the electrical connecting body 24 completes the frusto-conical volume 12 at the lower base so as to form a substantially conical volume. In other words, the lower portion 28, together with the signal conductors 7, define a radiating group of substantially monoconic shape.

According to an embodiment not shown of the invention, the antenna 1 comprises an input impedance matching circuit that connects the vertex 29 with the hot pole 14.

Again with reference to FIG. 3, The base portion 4 is internally hollow and houses a further electrical connection body 32 that electrically connects the ground conductors 3 to ground 15 of the coaxial connector 13.

The ground conductors 3 are electrically connected to the electric connecting body 32 in a radial pattern. More in detail, the base portion 4 comprises a plurality of through holes 33 that are drilled along the side surface 20 in respective positions angularly equispaced from one another with respect to the axis 2*a* and having respective axes preferably lying on the ground plane 21. The electrical connection body 32 is preferably made of metal, it is in the form of a ring coaxial with the axis 2*a* and has, along its own side surface 34, a plurality of radial holes 35, one by one coaxial with the holes 33. The end 19 of each ground conductor 3 is provided with a respective connector 36, which passes through a respective hole 33 and is connected to a respective hole 35.

Preferably, each hole 35 is internally threaded and each connector 36 has a respective externally threaded end portion 36*a*, so as to be screwed in the respective hole 35.

The base portion 4 and the portion 6 are so dimensioned as to maintain the two electrical connection bodies 24 and 32 at such mutual distance as to determine a certain electrical capacity, useful to improve the input impedance matching of the antenna 1, possibly in combination with the electrical inductance represented by the connecting cable 31. In particular, the vertex 29 of the conical shaped portion 28 is substantially on the ground plane 21, and therefore inside the ring of the electrical connection body 32.

The end portion 5 has a plurality of holes 37, that are drilled along the side surface 9 in respective positions angularly equispaced from one another with respect to the axis 2*a* and preferably having respective axes lying on plane 17. The first end 8 of each signal conductor 7 is provided with a respective connector 38, which is releasably connected to a respective hole 37.

Preferably, each hole 37 is internally threaded and each connector 38 has a respective externally threaded end portion 38*a*, so as to be screwed in the respective hole 37.

The releasable connection between the connectors 38 and the holes 37 allows disconnection of the signal conductors 7 from the end portion 5 and reconnection thereof with an opposite helicoidal winding direction, in order to change the circular polarisation direction.

Although the invention described above makes particular reference to a very precise exemplary embodiment, it is not to be considered limited to this embodiment, as it includes all variants, modifications or simplifications which would be apparent to the expert in the field, such as e.g.:

- a number of signal conductors 7 between three and nine, which decreases the mechanical complexity to the detriment of the performance which is slightly lower in terms of efficiency constancy and input impedance matching throughout the whole frequency band of use, or greater than ten, which progressively increases performance at the expense of the mechanical complexity resulting to be greater;
- the portions 4 and 5, which are in the form of a right prism coaxial with the axis 2*a*, and, correspondingly, the portion 6 and the upper portion 26 of the electrical connection body 32, which have a frusto-pyramidal shape coaxial with the axis 2*a*; and
- the coaxial connector 13 is positioned at a different point of the supporting structure 2 chosen according to the accessibility required by the specific installation of the antenna 1.

The antenna 1 described above in the various embodiments provides the following advantages:

- a high frequency bandwidth, approximately between 200 and 500 MHz, in particular thanks to the defined mono-conical shape of the winding of the signal conductors 7;
- a correct input impedance matching with respect to the 50Ω value on the aforementioned band of frequencies, in particular, thanks to the range of values selected for the angle β of the mono-conical shape with respect to the ground plane together with a sufficiently high number, equal to at least three signal conductors 7;
- a balanced (vertical and circular) mixed polarization suitable for terrestrial, nautical and satellite radiocommunications, in particular, thanks to the range of values selected for the helical winding angle θ of the signal conductors 7; and
- an omnidirectional radiation pattern with respect to a plane orthogonal to the axis 2*a*, i.e. with respect to a horizontal plane, and with a high gain for a wide range of elevation with respect to the horizontal plane, which is particularly suitable for satellite radiocommunication, in particular thanks to the defined mono-conical shape of the winding of the signal conductors 7.

In short, the antenna 1 has a relatively simple and robust mechanical structure with a single coaxial power connector, provides high efficiency with a wide frequency band and is suitable for both terrestrial and satellite radiocommunications.

The invention claimed is:

1. Helicoidal, mixed polarization mono-conical antenna comprising:

- a supporting structure (2) with a longitudinal axis (2*a*);
- a plurality of ground conductors (3) connected to an area around a first portion (4) of the supporting structure (2) so as to be arranged in a radial pattern relative to the axis (2*a*) in order to define a ground plane (21) of the antenna (1), wherein the ground plane (21) is orthogonal to the axis (2*a*);
- at least three signal conductors (7), that have respective first ends (8) that are connected to a second portion (5) of the supporting structure (2) and respective second ends (10) that are connected to a third portion (6) of the supporting structure (2) located between the first portion (4) and the second portion (5) along the axis (2*a*), that are wound in a helicoidal manner relative to the longitudinal axis (2*a*) and are shaped so as to define a substantially frusto-conical volume (12) that is coaxial to the longitudinal axis (2*a*) and has a first end oriented toward the first Portion (4) of the supporting structure (2) and a second end oriented toward the second portion (5) of the supporting structure (2); and
- a coaxial power supply connector (13) having a hot pole (14) electrically connected to said second ends (10).

2. The antenna in accordance with claim 1, wherein the plurality of ground conductors includes at least ten signal conductors (7).

3. The antenna in accordance with claim 1, wherein said first ends (8) are angularly equispaced from one another relative to said axis (2*a*) and said second ends (10) are angularly equispaced from one another relative to said axis (2*a*).

4. The antenna according to any of claim 1, wherein each one of said signal conductors (7) is wound in a helicoidal manner over an angle (8) having a value ranging from 80° to 190°.

5. The antenna according to claim 1, wherein a generatrix line (23) of said substantially frusto-conical volume (12) forms an angle (a) with said ground plane (21) having a value ranging from 35° to 55°.

6. The antenna according to claim 1, wherein each one of said ground and signal conductors (3, 7 comprises a respective metal strand covered by an electrically insulating material.

7. The antenna according to claim 1, wherein said first ends (8) are connected to said second portion (5) in a way as to intercept a plane (17) orthogonal to said axis (2*a*), which is at a distance (D) form said ground plane (21) measured along said axis (2*a*), which depends on a minimum operating frequency of the antenna, at which a determined efficiency of the antenna (1) is obtainable.

8. The antenna according to any of claim 1, further comprising a first electrical connection body (24) comprising a fourth portion (26) connected to said second ends (10) and a fifth portion (28) with a conical shape that is coaxial with respect to said axis (2*a*) and has a vertex (29) electrically connected to said hot pole (14) and facing said first portion (4), so as to form, together with said signal conductors (7), a radiant assembly with a substantially conical shape.

9. The antenna in accordance with claim 8, wherein said third portion (6) is internally hollow and has a plurality of first through holes (25) along a side surface (11); said fourth portion (26) situated within said third portion (6) and featuring a plurality of second holes (27) made in coaxial relation with the first through holes (25), said fifth portion (28) situated at least partially inside said third portion (6);

the second end (10) of each signal conductor (7) provided with a respective first connector (30), which goes through a respective one of said first through holes (25) and is connected to a respective one of said second holes (27).

10. The antenna according to claim 1, comprising a second electrical connection body (32), including a ring which is coaxial with said axis (2*a*) and is electrically connected to the ground terminal (15) of said coaxial power supply connector (13) and to said ground conductors (3).

11. The antenna in accordance with claim 10, wherein said first portion (4) is internally hollow and has a plurality of third through holes (33) along a side surface (20) thereof; said second electrical connection body (32) having a plurality of fourth holes (35) along a side surface (20) thereof, which are in coaxial relation with respective third through holes (33); each ground conductor (3) having a respective end (19) provided with a respective second connector (36), which goes through a respective one of said third through holes (33) and is connected to a respective one of said fourth holes (35).

12. The antenna according to claim 11, wherein said second portion (5) has a plurality of fifth holes (37) along a side surface (9) thereof; each of said first ends (8) of said signal conductors (7) provided with a respective third connector (38), which is connected in a releasable manner to a respective one of said fifth holes (37) so as to allow disconnection of the respective signal conductor (7) from the second portion (5) and reconnection in an opposite helicoidal winding direction in order to redirect circular polarization of the antenna (1).

13. The antenna according to claim 1, wherein said first ends (8) of the signal conductors (7) are situated along a side surface (9) of said second portion (5), having a shape of a cylinder or a right prism coaxial with said axis (2*a*), and said second ends (10) are situated along a side surface (11) of said third portion (6), having a frusto-conical or a frusto-pyramidal shape coaxial with the axis (2*a*).

14. The antenna in accordance with claim 13, wherein said fourth portion (26) has a frusto-conical or frusto-pyramidal shape coaxial with the axis (2*a*).

* * * * *